United States Patent [19]

Erdos

[11] 4,351,521

[45] Sep. 28, 1982

[54] RIDING TOY FOR CHILDREN WITH SPRING SUPPORT BASE

[75] Inventor: William A. Erdos, Summit County, Ohio

[73] Assignee: Eagle Rubber Co., Inc., Ashland, Ohio

[21] Appl. No.: 164,822

[22] Filed: Jun. 30, 1980

[51] Int. Cl.[3] ..... A63G 17/00

[52] U.S. Cl. ..... 272/52; 248/529

[58] Field of Search ..... 272/52, 52.5, 53.1, 272/53.2, 50, 54, 55, 1 R, 1 C, 110, 141; 248/188.7, 528, 529, 346; D21/66, 68, 69, 70, 242, 247

[56] References Cited

U.S. PATENT DOCUMENTS

| | | | |
|---|---|---|---|
| 2,971,758 | 2/1961 | Zimmers | 272/52.5 X |
| 2,993,530 | 7/1961 | Little et al. | 272/52 |
| 2,996,298 | 8/1961 | Grosse et al. | 272/52 |
| 3,078,479 | 2/1963 | Grosse et al. | 272/52 X |
| 3,210,075 | 10/1965 | Brookman et al. | 272/33 R |
| 3,475,019 | 10/1969 | Mutter et al. | 272/55 |
| 3,477,671 | 11/1969 | Goodridge | 248/529 |

*Primary Examiner*—Richard J. Apley
*Assistant Examiner*—Arnold W. Kramer
*Attorney, Agent, or Firm*—Gravely, Lieder & Woodruff

[57] ABSTRACT

A spring support base for a child's riding toy having a substantially stress resistant detachable connection between the child's riding seat and a spring, and a wide stance assembly for the spring in which the assembly permits legs to be attached by a single element to a base plate formed with leg receiving sockets having elements in positions to provide a snap fit grip on the legs.

6 Claims, 3 Drawing Figures

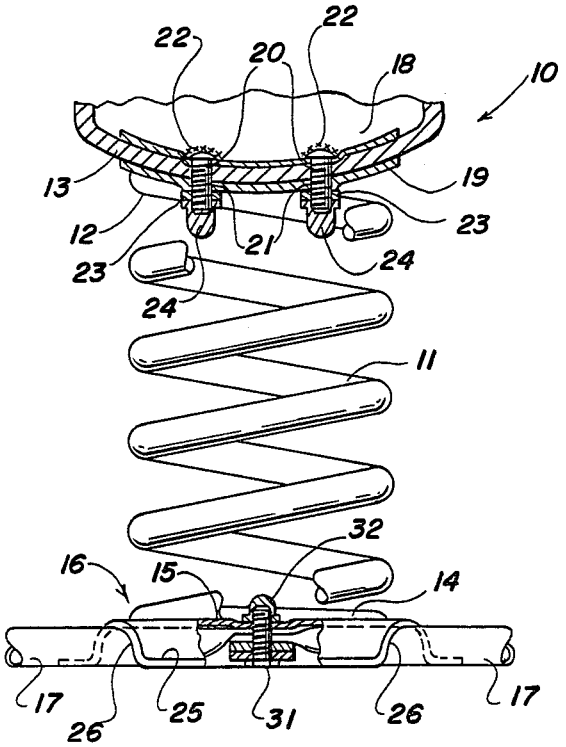
FIG. 1
FIG. 2
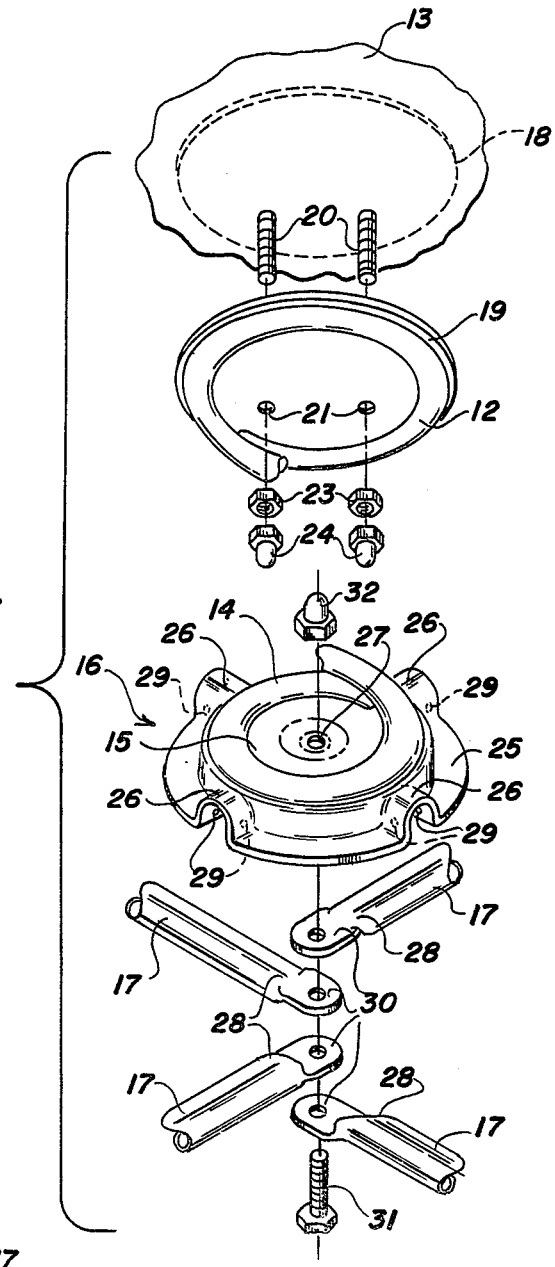
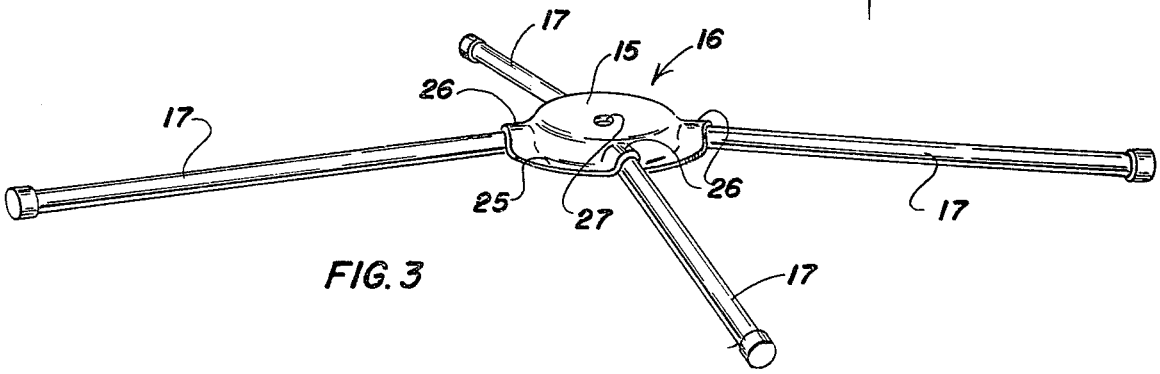
FIG. 3

RIDING TOY FOR CHILDREN WITH SPRING SUPPORT BASE

BACKGROUND OF THE INVENTION

1. Field of the Invention

The invention relates to a riding toy for children, and more particularly to a spring support base for the riding toy.

2. Description of the Prior Art

It is recognized that children's amusement riding equipment has embodied provisions for supporting a child in a sitting position and resilient means to allow the sitting child to gyrate within the limits of the resilient means. Such devices include such items as spring supports having the lower ends firmly anchored in the ground or attached to a fixed and substantial base, and having a riding saddle or similar device on which a child may sit while bouncing and swaying within the limits of the spring support. In amusement playground devices of this sort, the spring support is a coil spring having a certain amount of yieldability to allow it to compress and rebound in a vertical direction, but in the great majority of cases, the spring is limber to allow for lateral and fore and aft gyrations. Portability of playground devices has not been a factor due to the ease with which they can be carted away. As for indoors amusement devices, it has been generally the rule to provide wheels or casters so that damage to floors and rugs can be minimized.

BRIEF DESCRIPTION OF THE DISCLOSURE

The spring support base for the riding toy hereof comprises an assembly which is portable so that it may be used indoors as well as outdoors. The assembly is composed of a base member to which the bottom turn of a coil spring is secured, a plurality of leg elements providing a wide area stance for stabilizing the toy during coil spring gyrations, and an attachment fixture secured to the top turn of the coil spring and also secured to the seat-forming body.

The objects of the present invention are to provide a bouncy gyrating type amusement toy for children in the early years, to provide a safe and secure connection between the spring and the support for the child in the seat-forming body, and to provide a portable spring support base having the advantages of being safe for both indoor and outdoor play.

Other objects and advantages will appear from the drawings and the accompanying description.

BRIEF DESCRIPTION OF THE DRAWINGS

A preferred embodiment of the invention is depicted in the accompanying drawings, wherein:

FIG. 1 is an elevational view, partly in section, of the structure for an amusement toy carried on a spring support base;

FIG. 2 is an exploded perspective view of the various components making up the spring support base; and FIG. 3 is a perspective view of the base and leg assembly.

DETAILED DESCRIPTION OF A PREFERRED EMBODIMENT

Referring now to the drawings there can be seen in FIG. 1 an elevational view of the present riding toy support base 10 which comprises an upright coiled spring 11 having sufficient length to permit it to flex and gyrate under the reactions of a child. The upper turn 12 of the coiled spring is secured in a manner to be described presently to the bottom wall 13 of a molded body which may have various forms (not shown) suitable for permitting a child to be supported in a sitting position. The lower turn 14 of the coiled spring 11 is secured to the central area 15 of a circular base 16, and a plurality of elongated legs 17 project radially outwardly from the base 16 such that they are spaced apart at 90°.

It can be seen in FIGS. 1 and 2 that the wall 13 of the child supporting body is engaged on the inner side by a shallow dished plate or first attaching member 18, and the outer side of the wall 13 is engaged by a complementary dished second attaching member 19 so that the attaching members 18 and 19 and the interposed wall 13 constitute a sandwich structure by which a body may be detachably secured to the upper turn 12 of the coiled spring. A pair of securing elements 20 project from the first attaching member 18 through the wall 13 and through matching apertures 21 in the second attaching member 19. These elements have the inner ends non-rotatably secured to the first attaching member, either by welding or by the use of a suitable adhesive material 22. The downwardly and outwardly projecting ends of the securing elements 20 are adapted to be engaged by nuts 23, and by cap nuts 24 so as to prevent the loosening of the nuts 23. It can be observed that the respective nuts 23 and 24 are easily accessible through the spacing between the coils of the spring 11.

FIGS. 2 and 3 reveal important details of the lower end assembly for the spring support. It has already been pointed out that the base member 16 is provided with a surface 15 to which the lower turn 14 of the coiled spring 11 is secured. The base member 16 is formed with a lower peripheral flange 25, and the flange 25 is formed with inverted U-shaped semi-circular sockets 26 which open radially and are spaced at 90° around the flange 25. The surface 15 of the base plate is formed with a bolt receiving aperture 27 for a purpose presently to appear. Elongated leg members 17 have the inner end portions 28 snap fitted into the respective sockets 26 by reason of the formation in the socket walls of inwardly directed projections or nubbins 29 which are located to be slightly below the major diameter or dimension of the round stock when viewed in cross-section from which the legs 17 are formed, when the legs are seated in the sockets. There are a pair of nubbins 29 in each socket 26 which act to hold the legs 17 in working position. The inner ends 30 of the respective legs 17 have been flattened or are otherwise formed to permit these ends to be assembled in overlapping relation so that a single securing bolt 31 may pass through the flattened ends 30 from underneath the base plate 16 and emerge at the aperture 27 to receive a suitable cap nut 32.

it can be seen in FIG. 3 that the respective legs 17 have a slight angular position with respect to a supporting surface such that the base plate 16 is slightly raised from the support surface. This arrangement ensures that the riding toy will have the legs operative to maintain a wide stance so as to guard against toppling during gyrations caused by a child using the toy. Furthermore, the securing elements 20 connecting the body wall 13 to the spring 11 are arranged in an alignment which is directed at approximately 45° to the angular spacing between the legs. In other words, the alignment of the securing elements 20 is not intended to be aligned along the axis of any of the legs 17, but has been turned to a 45° orientation so that fore and aft gyrations of the body will be resisted substantially equally by pairs of legs, and there will be only slight tendency for any pair of legs to break contact with the supporting surface.

A great advantage for the present riding toy and its novel spring support base is that the assembly is equally suitable for indoor or outdoor use. The coiled spring 11 may have any suitable vertical length to substantially match the physical stature of the child. For example, shorter springs and of less stiffness may be incorporated for the smallest children and taller springs having greater stiffness may be incorporated for older children. Since the normal orientation of the child supporting body is directed to substantially bifurcate the angular spacing between any pair of legs, normal child induced gyrations will develop a smooth, easy and quiet rocking motion.

The body for supporting the child may be formed of high density polyethylene material, and its attachment to the upper end of the spring 11 is uniquely shaped with a smooth and shallow downwardly convex form of the inner and outer attachment members 18 and 19 to avoid having zones of high stress.

What is claimed is:

1. In a riding toy for children the improvement of a spring and base support structure for the riding toy having a body formed with a bottom wall, the improvement comprising:

(a) an upright spring member forming a vertical column having upper and lower ends;

(b) attachment means between the upper end of said spring and the bottom wall of the riding toy body;

(c) base means formed with a central raised area supporting said lower end of said spring member, said base means having flange means surrounding said central area at a lower level and formed with a plurality of inverted U-shaped semi-circular sockets opening outwardly from the space beneath said raised central area;

(d) elongated leg members having round portions in cross-section seated in said sockets and flattened inner ends projecting into the area under said raised central area of said base means;

(e) a single securing element connecting said flattened inner ends to said base means; and (f) a pair of elements in each socket engaged with said round portions of said leg members from opposite sides and below the major cross-sectional dimension of said round portions for retaining said leg members seated in snap fit relation in said respective sockets.

2. The riding toy improvement set forth in claim 1 wherein said base means sockets are radially directed to space said leg members in directions substantially ninety degrees apart, and said attachment means between said upper end of said spring and the bottom wall of the riding toy body includes a pair of securing elements in spaced relation having an alignment substantially forty five degrees to the spacing between said leg members.

3. The riding toy improvement set forth in claim 2 wherein said upright spring member is a coil spring, and said pair of securing elements have the spaced alignment directed substantially diametrically across the major dimension of the coils of said spring member.

4. The riding toy improvement set forth in claim 1 wherein said inner ends of said leg members are independent of each other and meet in lapped relationship beneath the raised central area of said base means; and said single element connects said lapped inner ends to each other and to said central area.

5. A riding toy for children comprising: a hollow child supporting body having a shallow convex bottom surface; a first attachment member located inside said hollow body formed to substantially match said convex surface carried by said first member in position to project outwardly of said body through said bottom surface; a vertically upright coil spring; a second attachment member carried by the upper end of said coil spring and formed with apertures to receive said securing elements projecting from said bottom surface, said second member being shaped to conform substantially to said bottom surface of said body; means engaging said projecting elements and said second member for securing said body to said upper end of said spring; a base member having a raised circular central portion in position to be connected to the lower end of said coil spring, said base member having a marginal flange at a lower level relative to said raised central portion, said flange having inverted U-shaped semi-circular sockets opening radially from and being spaced about the periphery of said flange to open to the area under said central portion; an elongated leg member for each said socket, each leg member having a round portion in cross-section located in a socket and an outer end portion projecting outwardly of said socket in position to cooperate with other leg members to support the riding toy against toppling, each leg member having a flattened inner end; means securing the inner flattened ends of each of said leg members in a lapped relationship and secured to said base member; and each socket having inwardly projecting elements positioned for retaining the leg seated in a snap-fitted relation therein.

6. The riding toy set forth in claim 5 wherein said flattened inner ends of certain of said leg members are spaced from said central portion of said base at different distances so that when secured in lapped relationship said outer portions of said legs are positioned to support said base member in a raised position.

* * * * *